US009812798B2

(12) United States Patent
Yu et al.

(10) Patent No.: US 9,812,798 B2
(45) Date of Patent: Nov. 7, 2017

(54) ELECTRICAL CONNECTOR WITH HEAT DISSIPATING PATH

(71) Applicant: ALLTOP ELECTRONICS (SUZHOU) LTD., Taicang, JiangSu Province (CN)

(72) Inventors: Wang-I Yu, Jhonghe (TW); Ren-Bao Hu, Jhonghe (TW); I-Hung Cheng, Jhonghe (TW)

(73) Assignee: ALLTOP ELECTRONICS (SUZHOU) LTD., Taicang (CN)

( * ) Notice: Subject to any disclaimer, the term of this patent is extended or adjusted under 35 U.S.C. 154(b) by 159 days.

(21) Appl. No.: 14/561,508

(22) Filed: Dec. 5, 2014

(65) Prior Publication Data

US 2016/0064837 A1 Mar. 3, 2016

(30) Foreign Application Priority Data

Sep. 1, 2014 (CN) ..... 2014 1 0439533

(51) Int. Cl.
*H01R 12/57* (2011.01)
*H01R 13/00* (2006.01)
*H01R 13/41* (2006.01)

(52) U.S. Cl.
CPC ..... *H01R 12/57* (2013.01); *H01R 13/41* (2013.01)

(58) Field of Classification Search
CPC ..... H01R 12/57; H01R 13/629; H01R 13/41
USPC ..... 439/485, 487, 374, 692
See application file for complete search history.

(56) References Cited

U.S. PATENT DOCUMENTS 5,453,016 A * 9/1995 Clark ..... H01R 12/724 439/79
5,971,774 A * 10/1999 Kuki ..... H01R 12/712 439/79
5,980,271 A * 11/1999 MacDougall ..... H01R 13/41 439/733.1
6,447,340 B1 * 9/2002 Wu ..... H01R 12/716 439/660
6,482,038 B2 * 11/2002 Olson ..... H01R 23/688 439/607.1
6,971,884 B2 * 12/2005 Zhao ..... H01R 12/721 439/485
7,537,465 B2 * 5/2009 Fang ..... H01R 12/716 439/247
7,726,982 B2 * 6/2010 Ngo ..... H01R 13/42 439/206

(Continued)

*Primary Examiner* — Amy Cohen Johnson
*Assistant Examiner* — Milagros Jeancharles
(74) *Attorney, Agent, or Firm* — Sughrue Mion, PLLC

(57) ABSTRACT

An electrical connector mounted to a Printed Circuit Board (PCB) includes an insulating housing having a mating face, a mounting face and a rear wall positioned between the mating face and the mounting face. The housing defines a number of contact-receiving passageways and a number of heat dissipating slots communicating with the contact-receiving passageways. a number of conductive contacts are respectively received in the passageways. Each contact includes a contacting portion, a termination portion and an intermediate portion. The insulating housing has a heat dissipating section defined between the mounting face and the rear wall. The heat dissipating section communicates with the heat dissipating slots to thereby defining a heat dissipating path therebetween.

13 Claims, 7 Drawing Sheets

(56) References Cited

U.S. PATENT DOCUMENTS

| | | | | |
|---|---|---|---|---|
| 7,914,305 | B2 * | 3/2011 | Amleshi | H01R 13/6471 439/101 |
| 7,938,675 | B1 * | 5/2011 | Yu | H01R 12/724 439/485 |
| 8,038,466 | B1 * | 10/2011 | Tai | H01R 12/7082 439/206 |
| 8,303,331 | B2 * | 11/2012 | Yu | H01R 12/7088 439/206 |
| 9,048,569 | B2 * | 6/2015 | Chen | H01R 12/716 |
| 9,142,905 | B2 * | 9/2015 | Yu | H01R 13/4367 |
| 2008/0207029 | A1 * | 8/2008 | Defibaugh | H01R 13/46 439/206 |
| 2008/0318464 | A1 * | 12/2008 | Yuan | H01R 12/716 439/485 |
| 2010/0048056 | A1 * | 2/2010 | Daily | H01R 13/113 439/485 |
| 2011/0076871 | A1 * | 3/2011 | Yu | H01R 12/7088 439/345 |
| 2013/0095693 | A1 * | 4/2013 | Yu | H01R 12/724 439/485 |
| 2013/0337679 | A1 * | 12/2013 | Tai | H01R 13/631 439/485 |

* cited by examiner

ELECTRICAL CONNECTOR WITH HEAT DISSIPATING PATH

BACKGROUND OF THE INVENTION

1. Field of the Invention

The present invention relates to an electrical connector, more particularly to an electrical connector mounted on a Printed Circuit Board.

2. Description of Related Art

With the rapid development of electronic technology, electrical connectors are widely used in electric products for exchanging information, data etc. with periphery devices. An electrical connector generally comprises an insulative housing and a plurality of conductive contacts received in the insulative housing. When a complementary connector is removed from the engaged electrical connector, the conductive contact is easily broken away from the insulating housing because of a large removal force. Moreover, especially for electrical connectors providing power, the conductive contacts always generate a large mount of heat during use. The heat should be dissipated immediately or otherwise such heat will destroy the stable signal transmission and high transmission efficiency.

Hence, it is necessary to improve the electrical connector to address problems mentioned above.

BRIEF SUMMARY OF THE INVENTION

Accordingly, an object of the present invention is to provide a electrical connector which provides a heat dissipating path.

In order to achieve the above-mentioned object, an electrical connector mounted to a Printed Circuit Board (PCB) for mating with a complementary connector, comprises an insulating housing having a mating face confronting the complementary connector, a mounting face opposite to the mating face and a rear wall positioned between the mating face and the mounting face along a front-to-back direction. The insulating housing defines a plurality of contact-receiving passageways penetrating from the mating face to the mounting face and a plurality of heat dissipating slots communicating with the contact-receiving passageways. A plurality of conductive contacts are respectively received in the contact-receiving passageways. Each conductive contact comprises a contacting portion, a termination portion adapted for electrically connecting with the Printed Circuit Board, and an intermediate portion connecting the contacting portion with the termination portion and retained on the rear wall. The insulating housing comprises heat dissipating section defined between the mounting face and the rear wall. The heat dissipating section communicates with the heat dissipating slots to thereby defining a heat dissipating path therebetween.

The foregoing has outlined rather broadly the features and technical advantages of the present invention in order that the detailed description of the invention that follows may be better understood. Additional features and advantages of the invention will be described hereinafter, which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
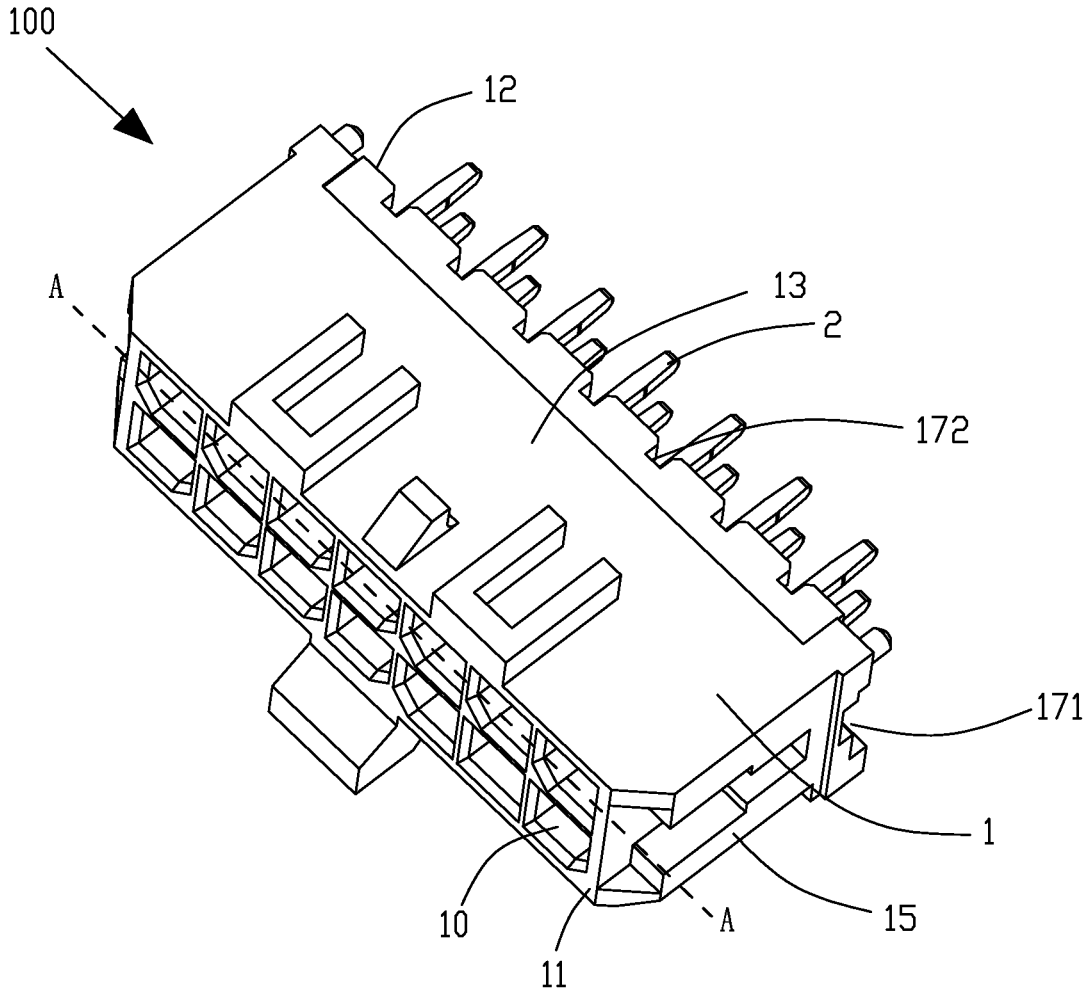
FIG. 1 is a perspective view of an electrical connector in accordance with a first embodiment of the present invention.

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Reference will be made to the drawing figures to describe the present invention in detail, wherein depicted elements are not necessarily shown to scale and wherein like or similar elements are designated by same or similar reference numeral through the several views and same or similar terminology.

Please refer to FIGS. 1-5, an electrical connector 100 in accordance with the present invention is used to be mounted on a Printed Circuit Board (not shown) to cooperate with a corresponding complementary connector (not shown). The electrical connector 100 comprises an insulating housing 1 and a plurality of conductive contacts 2 accommodated in the insulating housing 1.

Figure 2:
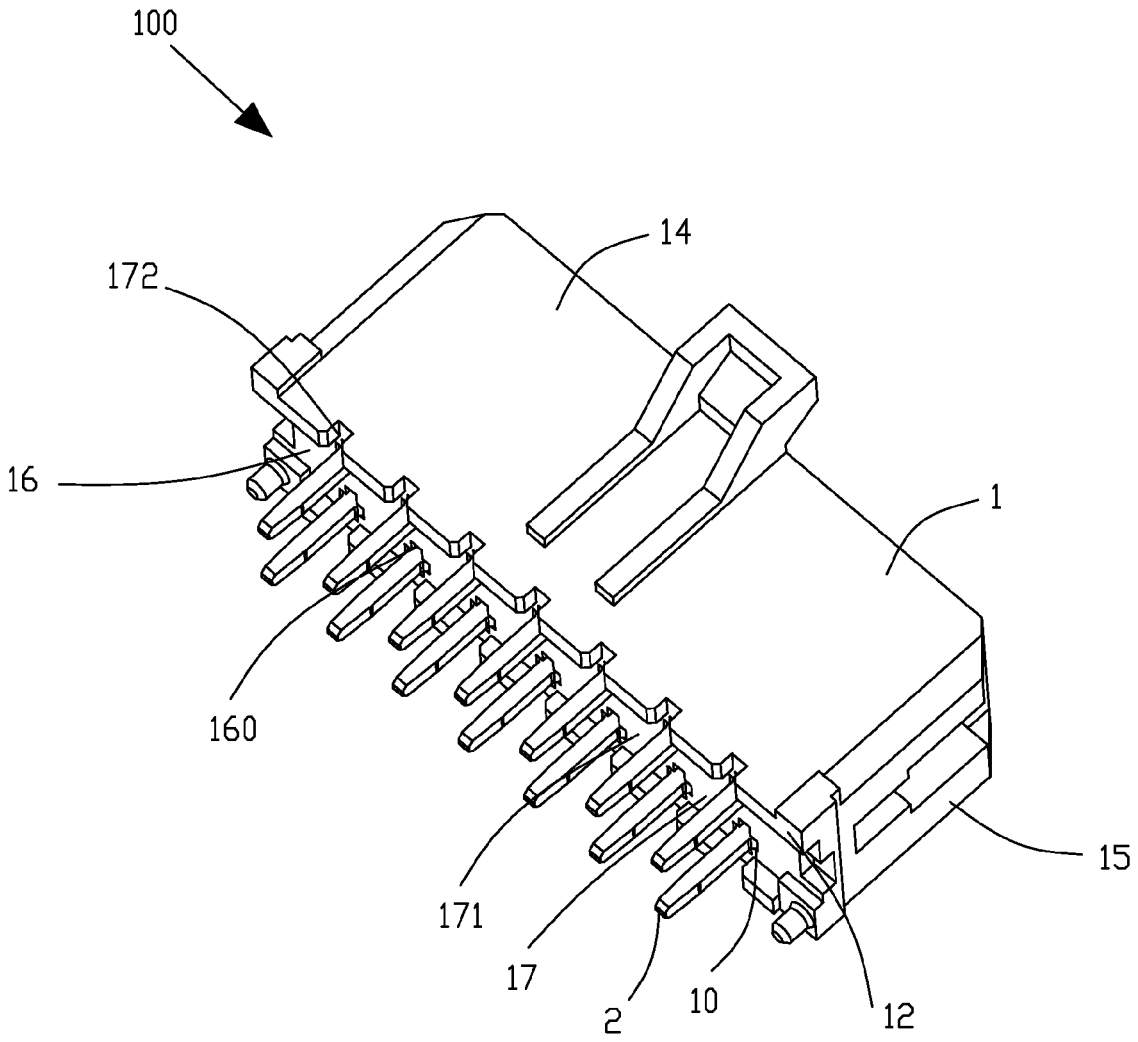
FIG. 2 is another perspective view of the electrical connector as shown in FIG. 1.
Figure 3:
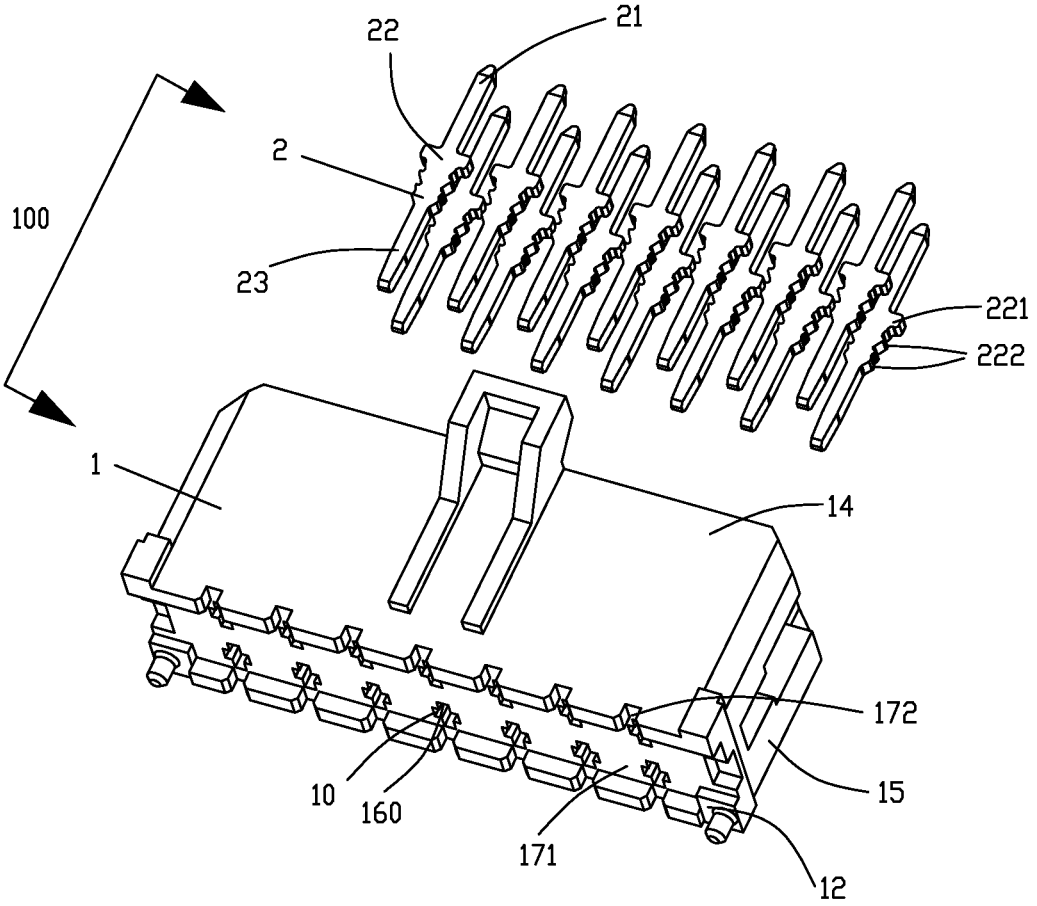
FIG. 3 is an exploded, perspective view of the electrical connector in accordance with a first embodiment of the present invention.

Please refer to FIGS. 1-3, the insulating housing 1 comprises a front, rectangular mating face 11 for mating with the complementary connector, a rectangular mounting face 12 opposite to the mating face 11, and a plurality of contact-receiving passageways 10 penetrating through the mating face 11 and the mounting face 12. The insulating housing 1 also comprises a top wall 13, a bottom wall 14 opposite to the top wall 13, and a pair of side walls 15 connecting the top wall 13 with the bottom wall 14. A rear wall 16 is formed between the mating face 11 and the mounting face 12. The top wall 13 is connecting the mating face 11 and the mounting face 12 and over-crossing the contact-receiving passageways 10. A plurality of heat dissipating slots 160 are defined through the rear wall 16 and communicate with corresponding contact-receiving passageway 10. A heat dissipating section 17 is recessed from the mounting face along a front-to-back direction, which is opened and exposed to the outside. The heat dissipating section 17 is communicating with the heat dissipating slots 160. The rear wall 16 also has a limitation means 18 formed in inside wall of each of the contact-receiving passageways 10. The limitation means 18 comprises a first protrusion 181 and a second protrusion 182 formed on the inside wall of the passageway 10. The first protrusion 181 and the second protrusion 182 together define a step shape portion to thereby retaining a conductive contact 2. In such a manner, the conductive contact 2 can only be assembled to the insulating housing 1 from the mating face 11. In the preferred embodiment, the insulating housing 1 comprises opposite top and bottom surfaces (not labeled) thereof. A pair of assembling recesses (not labeled) are recessed from the two side walls 15. The insulating housing 1 also has a pair of guiding protrusions (not labeled) formed on one of the top and bottom surfaces and one guiding block(not labeled) formed on the other one.

Referring to FIG. 2, in accordance with the first embodiment of the present invention, the heat dissipating section 17 of the electrical connector 100 comprises a heat dissipating recess 171 and a plurality of heat dissipating grooves 172 communicating with the heat dissipating recess 171. The heat dissipating recess 171 is recessed from the mounting face 12 and located between the top wall 13 and the bottom wall 14. The plurality of heat dissipating grooves 172 are respectively defined on opposite edges of the top wall 13 and the bottom wall 14. During application of the electrical connector 100, the heat generated from the conductive contacts 2 is passing from the heat dissipating slots 160, through the heat dissipating section 17, and finally dissipating to the outside from the heat dissipating recess 171 and the grooves 172 from different directions across the mounting face 12. A heat dissipating path is formed between the heat dissipating slots 160, the heat dissipating recess 171 and the grooves 172.

Figure 4:
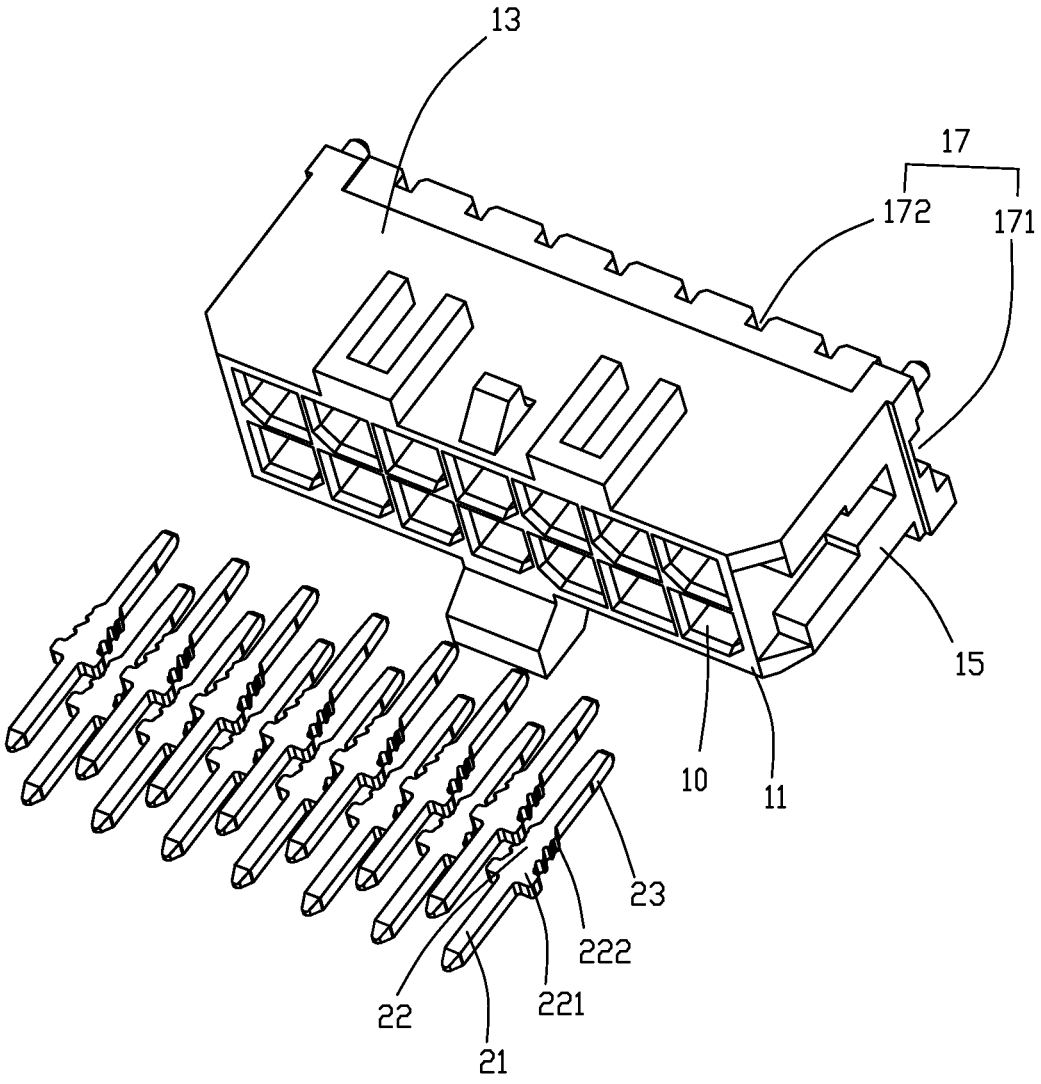
FIG. 4 is another exploded, perspective view of the electrical connector in accordance with a first embodiment of the present invention.
Figure 5:
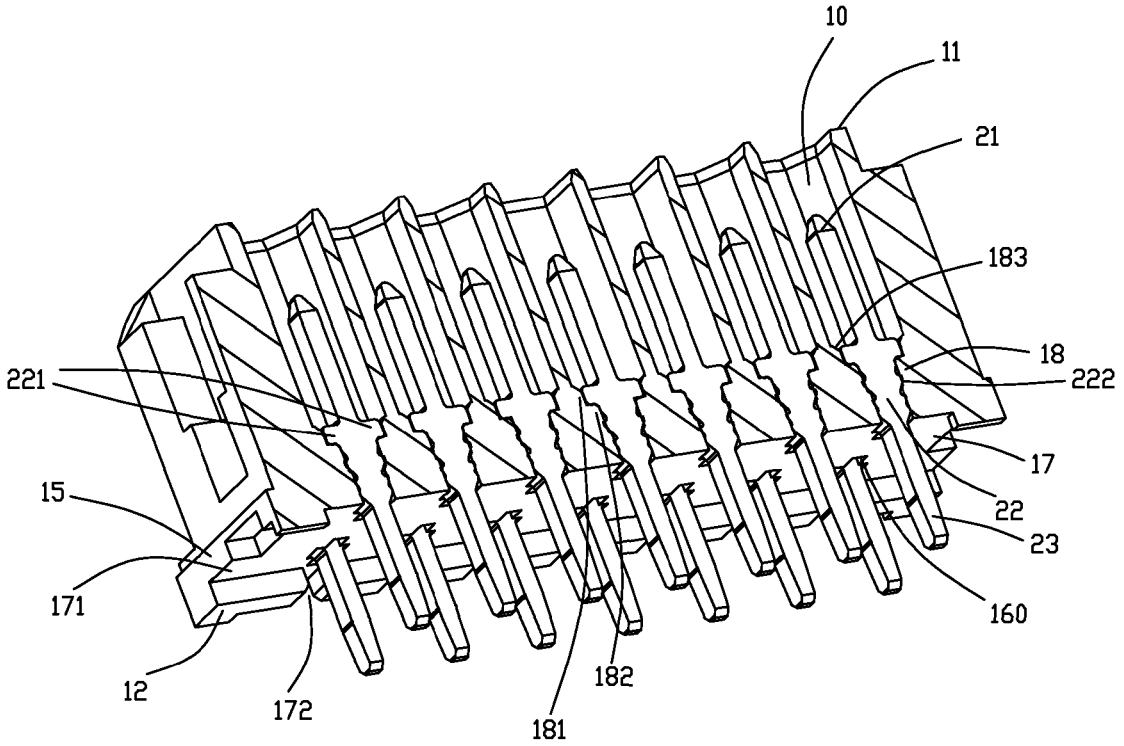
FIG. 5 is a cross-section view of the electrical connector shown in FIG. 1 along line A-A.

Referring to FIGS. 3 and 4, the conductive contact 2 has a contacting portion 21 forwardly extending within the contact-receiving passageway 10, a termination portion 23 adapted for electrically connecting with the Printed Circuit Board, and an intermediate portion 22 connecting the contacting portion 21 with the termination portion 23 and being retained on the rear wall 16. The intermediate portion 22 of each conductive contact 2 has a pair of retaining protrusions 221 formed along two opposite edges thereof and a plurality of barbs 222 following the retaining protrusions 221. The retaining protrusions 221 cooperate with the first protrusion 181 and the second protrusion 182 to thereby limiting an insertion direction of the conductive contact 2 from the mating face 11. The barbs 222 are interfering-fitted within the contact-receiving passageway 10. A slanted guiding face 183 is formed in each of the first protrusion 181 to thereby and guiding an insertion of the conductive contact 2. By such an arrangement, when the complementary connector is removed from the electrical connector 100, the conductive contact 2 cannot be removed together. The termination portions 23 of the conductive contacts 2 are arranged into two rows along a top-to-down direction, which are exposed to the heat dissipating recess 171.

Figure 6:
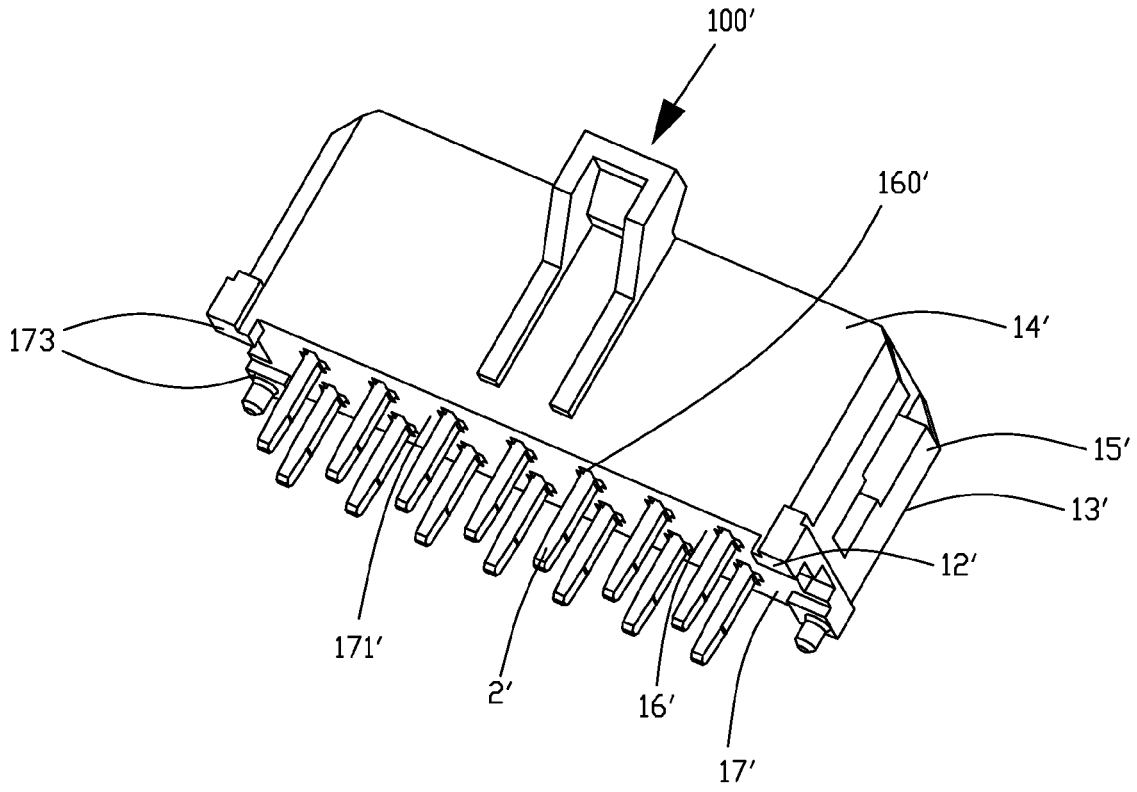
FIG. 6 is a perspective view of the electrical connector in accordance with a second embodiment of the present invention.

As shown in FIG. 6, in accordance with the second embodiment of the present invention, the heat dissipating section 17' of the electrical connector 100' is a heat dissipating recess 171' which is recessed from the mounting face 12' towards the rear wall 16'. There are four assembling blocks 173 formed on corners of the insulating housing 1 with the mounting face 12' being defined behind the assembling blocks 173 along the front-to-back direction. The heat dissipating recess 171' is communicating with the heat dissipating slots 160'. By such an arrangement, the heat generated from the conductive contacts 2' is passing from the heat dissipating slots 160' and finally dissipating to the outside from the heat dissipating recess 171'.

Figure 7:
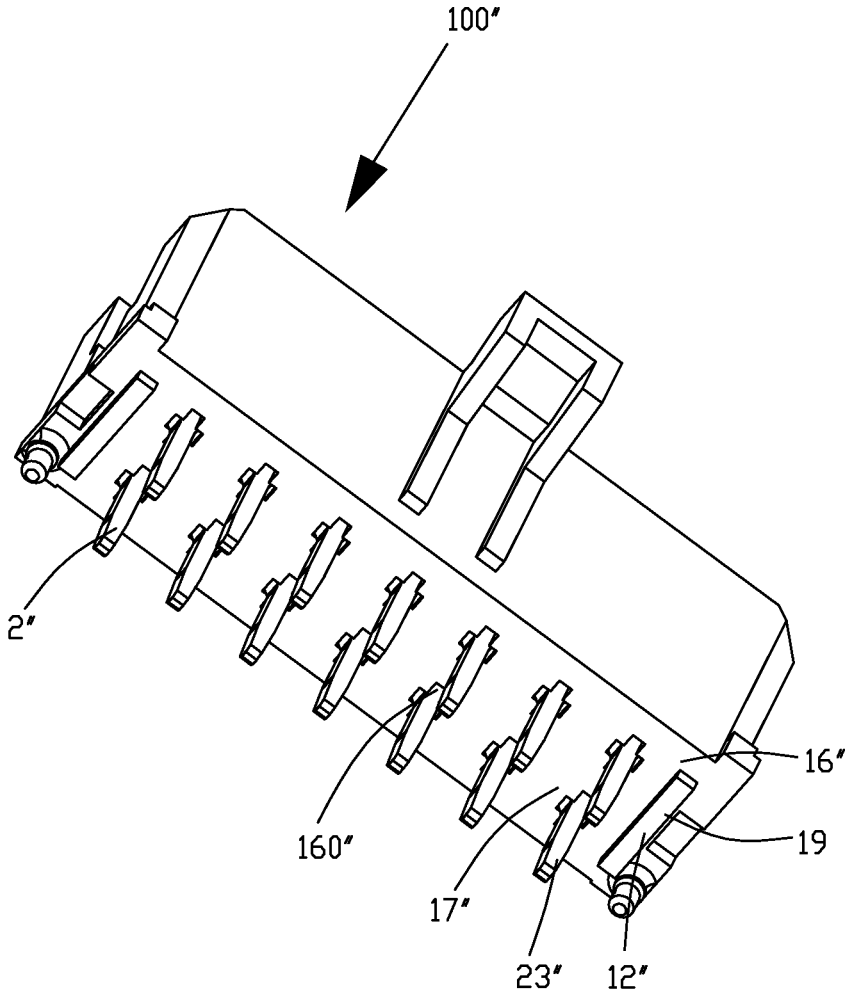
FIG. 7 is a perspective view of the electrical connector in accordance with a third embodiment of the present invention.

As shown in FIG. 7, in accordance with the third embodiment, the rear wall 16" of the electrical connector 100" forms a pair of assembling ribs 19 at opposite sides of the two rows of termination portions 23" of the conductive contacts 2". The heat dissipating section 17" is defined between the mounting face 12" and the rear wall 16" and communicates with the heat dissipating slots 160". By such an arrangement, the heat generated from the conductive contacts 2" is passing from the heat dissipating slots 160" and finally dissipating to the outside from the heat dissipating recess 171".

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. For example, the tongue portion is extended in its length or is arranged on a reverse side thereof opposite to the supporting side with other contacts but still holding the contacts with an arrangement indicated by the broad general meaning of the terms in which the appended claims are expressed.

We claim:

1. An electrical connector mounted to a printed circuit board (PCB) for mating with a complementary connector, comprising:

an insulating housing comprising a mating face confronting the complementary connector, a mounting face opposite to the mating face and a rear wall positioned between the mating face and the mounting face along a front-to-back direction, the insulating housing defining a plurality of contact-receiving passageways penetrating from the mating face to the rear wall and a plurality of heat dissipating slots communicating with the contact-receiving passageways; and a plurality of conductive contacts respectively received in the contact-receiving passageways, each conductive contact comprising a contacting portion, a termination portion adapted for electrically connecting with the printed circuit board, and an intermediate portion connecting the contacting portion with the termination portion and retained on the rear wall;

wherein the insulating housing comprises a heat dissipating section defined between the mounting face and the rear wall, and wherein the heat dissipating section communicates with the heat dissipating slots to thereby define a heat dissipating path therebetween, the insulative housing has a top wall connecting the mating face and the rear wall, and a plurality of heat dissipating grooves are arranged on the top wall along a transverse direction, the heat dissipating grooves are communicated with an exterior along an up-to-down direction and the front-to-back direction;

wherein the conductive contact has a pair of retaining protrusions formed along two opposite side edges of the intermediate portion thereof and wherein the contact-receiving passageway defines a limitation means in an inside wall for retaining the conductive contact by engaging with the retaining protrusions.

2. The electrical connector as claimed in claim 1, wherein the heat dissipating section comprises a heat dissipating recess recessed from the mounting face, and wherein the termination portions of the conductive contact are exposed within the heat dissipating recess.

3. The electrical connector as claimed in claim 2, wherein the insulating housing comprises assembling blocks formed at corners thereof with the mounting face being behind the assembling blocks along the front-to-back direction.

4. The electrical connector as claimed in claim 2, wherein the termination portions of the conductive contacts are arranged into two rows with a pair of assembling ribs located at opposite sides of the termination portions.

5. The electrical connector as claimed in claim 1, wherein the limitation means comprises a first protrusion and a second protrusion formed on the inside wall of the passageway, and wherein the first protrusion and the second protrusion together defines a step shape to thereby retain the retaining protrusion.

6. The electrical connector as claimed in claim 5, wherein the first protrusion defines a slanted guiding face thereof for guiding insertion of the conductive contact from the mating face.

7. The electrical connector as claimed in claim 1, wherein the contact-receiving passageways are arranged in two rows and a pair of assembling recesses are defined on opposite sides of the two rows of contact-receiving passageways.

8. The electrical connector as claimed in claim 7, wherein the insulating housing comprises a pair side walls and opposite top and bottom surfaces thereof, and wherein the pair of assembling recesses are recessed from the two side walls.

9. The electrical connector as claimed in claim 8, wherein the insulating housing has a pair of guiding protrusions formed on one of the top and bottom surfaces and a guiding block formed on the other one.

10. The electrical connector as claimed in claim 1, wherein the heat dissipating grooves align with the corresponding heat dissipating slots along the up-to-down direction respectively.

11. The electrical connector as claimed in claim 1, wherein the heat dissipating grooves penetrate the top wall along the up-to-down direction.

12. The electrical connector as claimed in claim 1, wherein the insulative housing has a bottom wall opposite to the top wall, and a plurality of heat dissipating grooves are defined on the bottom wall and communicated with the exterior along the up-to-down direction.

13. An electrical connector mounted to a printed circuit board for mating with a complementary connector, comprising:

an insulating housing comprising a mating face confronting the complementary connector, a mounting face opposite to the mating face and a rear wall positioned between the mating face and the mounting face along a front-to-back direction, the insulating housing defining a plurality of contact-receiving passageways penetrating from the mating face to the rear wall and a plurality of heat dissipating slots communicating with the contact-receiving passageways; and a plurality of conductive contacts respectively received in the contact-receiving passageways, each conductive contact comprising a contacting portion, a termination portion adapted for electrically connecting with the printed circuit board, and an intermediate portion connecting the contacting portion with the termination portion and retained on the rear wall;

wherein the insulating housing comprises a heat dissipating section defined between the mounting face and the rear wall, and wherein the heat dissipating section communicates with the heat dissipating slots to thereby define a heat dissipating path therebetween, the insulative housing has a top wall connecting the mating face and the rear wall, and a plurality of heat dissipating grooves are arranged on the top wall along a transverse direction, the heat dissipating grooves are communicated with an exterior along an up-to-down direction and the front-to-back direction, the contact-receiving passageways are arranged in two rows and a pair of assembling recesses are defined on opposite sides of the two rows of contact-receiving passageways, the insulating housing comprises a pair side walls and opposite top and bottom surfaces thereof, and wherein the pair of assembling recesses are recessed from the two side walls, the insulating housing has a pair of guiding protrusions formed on one of the top and bottom surfaces and a guiding block formed on the other one.

* * * * *